US005953861A

United States Patent [19]

Podgwaite

[11] Patent Number: 5,953,861

[45] Date of Patent: Sep. 21, 1999

[54] ROOF FREEZE PROTECTION APPARATUS AND METHOD

[76] Inventor: Frank C. Podgwaite, 78 Culver La., North Haven, Conn. 06473

[21] Appl. No.: 09/088,179

[22] Filed: Jun. 1, 1998

Related U.S. Application Data

[63] Continuation-in-part of application No. 08/845,102, Apr. 21, 1997, abandoned.

[51] Int. Cl.[6] ..... E04D 13/064

[52] U.S. Cl. ..... 52/11; 52/60; 52/96; 52/97; 52/105; 52/741.4; 52/746.11; 52/748.1

[58] Field of Search ..... 52/11, 60, 94–97, 52/105, 741.3, 741.4, 746.11, 748.1

[56] References Cited

U.S. PATENT DOCUMENTS

| | | | |
|---|---|---|---|
| 1,343,461 | 6/1920 | Marberg . | |
| 3,550,381 | 12/1970 | South | 52/11 |
| 4,271,643 | 6/1981 | Sweers . | |
| 4,300,319 | 11/1981 | Frost et al. . | |
| 4,385,010 | 5/1983 | Bosne | 52/11 X |
| 4,912,888 | 4/1990 | Martin et al. | 52/12 |
| 5,560,157 | 10/1996 | Rotter | 52/95 |

FOREIGN PATENT DOCUMENTS

| | | | |
|---|---|---|---|
| 1468595 | 1/1967 | France | 52/11 |
| 2005475 | 1/1978 | Germany . | |
| 2-58665 | 2/1990 | Japan . | |
| 58665 | 2/1990 | Japan | 52/11 |
| 2093494 | 9/1982 | United Kingdom | 52/11 |
| 2275277 | 8/1994 | United Kingdom | 52/11 |

*Primary Examiner*—Robert Canfield
*Attorney, Agent, or Firm*—David L. Volk

[57] ABSTRACT

A channel-shaped elongated member has a first wall which is opposite a second wall, and a floor. The second wall has a distal portion, also bifurcated into a primary wall and a secondary wall, forming a receiving channel. There is also a sealing means for forming a watertight seal between an underlayment waterproofing material and the receiving channel. In one embodiment, the receiving channel is composed of a malleable material wherein the primary wall of the receiving channel is externally marked in order to provide a guideline for crimping the channel thereby ensuring a watertight seal after the application of caulk. In another embodiment, the primary wall of the receiving channel is angled toward the secondary wall in order to firmly receive an underlayment waterproofing material, thereby forming a watertight seal when caulk is added.

8 Claims, 4 Drawing Sheets

ROOF FREEZE PROTECTION APPARATUS AND METHOD

REFERENCE TO RELATED APPLICATIONS

This application is a continuation-in-part of application Ser. No. 08/845,102, filed Apr. 21, 1997, now abandoned.

BACKGROUND OF THE INVENTION

1. Field of the Invention

The present invention relates generally to roofing materials, and more particularly to roofing drainage and ice-dam prevention systems.

2. Description of the Related Art

It is a common problem for water to drain off a roof and collect in a gutter because the drain is somehow blocked. When this occurs in colder climates, the excess water may freeze if the ambient temperature is low enough. The resultant ice-dam backs up onto the eaves of the house and forces its way under the shingles, thereby causing structural damage. This problem is largely endemic to the eaves of the roof because unlike the rest of the roof, the eaves receive no warmth from the living area of the house.

Another problem, common to homeowners, that occurs when the gutters get clogged by leaves or other foreign objects is the problem of stagnant water. Just as in the ice-dam problem, sitting water can cause serious damage to the edges of the roof if the gutter system is not watertight.

Attempts have been made to solve this problem, such as the product known as CELO-GUARD (TM), a product of Celotex. This product is a flexible underlayment designed to lay under the shingles on a roof so that water cannot penetrate down to the wood. It is constructed of a rubberized asphalt roofing sheet which is reinforced with a fiber glass mat. The product easily rolls and unrolls by hand. One side of the material is self-adhesive. The self-adhesive feature means the sheets firmly bond themselves to the roof deck and to each other, forming a continuous barrier against water intrusion.

Because shingles are installed on top of the underlayment, nails or staples will penetrate the underlayment. The rubberized asphalt self-seals around the nail or staple to maintain watertight integrity.

Gaf Materials Corporation advertises a product known as WEATHER WATCH (TM) Waterproof Underlayment, which performs in substantially the same manner as the Celotex CELO-GUARD (TM).

Without the benefit of a seal between the gutter and the underlayment, however, water can still force its way beneath the underlayment's surface and damage the home.

One known effort to provide a seal between the gutter and the underlayment is disclosed in U.S. Pat. No. 4,300,319 to Frost et al, which discloses a roll formed or extruded aluminum piece comprising a first plate which acts as the underlayment, underlying the roof covering, a second plate oriented to fit flush against the fascia board, and a downwardly opening channel between the first and second plates, which receives the inner wall of a conventional gutter. A disadvantage of the apparatus disclosed by Frost et al., is that the invention cannot be used with existing underlayment materials such as the WEATHER WATCH (TM) Waterproof Underlayment and the Celotex CELO-GUARD (TM) described above, or with other similar materials. These existing underlayment materials do not include the required downwardly opening channel. The aluminum material of the Frost et al. reference must be formed to match the slope of the roof, and the material is not self-sealing around any fasteners which would penetrate; thus it lacks the resistance to water penetration of the products which self-seal.

Other apparatus have been developed for supporting gutters from rigid plates which underly the roof covering. U.S. Pat. Nos. 1,343,461 to Marberg, and 4,271,643 to Sweers, as well as Japanese Patent 2-58,665 to Sekisui Chemical Company, LTD disclose such inventions. Each of these inventions include unique structure for the rigid plates which underly the roof covering; thus, they are not suitable for use with the WEATHER WATCH (TM) Waterproof Underlayment and the Celotex CELO-GUARD (TM) described above, or with other similar materials. The rigid materials must be formed to match the slope of the roof, and they are not self-sealing. Furthermore, these inventions were not designed for preventing ice dams at eaves of roofs, but were instead designed for supporting gutters from roofs.

German Patent 2005475 to L. Stromeyer and Co. discloses a method of supporting a gutter from a wall of a tent. This patent discloses an elongated metal plate which attaches to a side wall of a tent, beneath a strip of flashing. The plate has a thickened bottom edge, which is captured by a series of spaced clips attached to a back wall of a gutter. This invention was also not designed for preventing ice dams. The objects of the invention are to direct rain water away from the tent wall and into the gutter, and to support the gutter. This invention would not work properly with the flexible WEATHER WATCH (TM) and CELO-GUARD (TM) products, or similar materials, because the gutter would not be suspended from the tent in the proper upright position unless a rigid plate is used.

What is needed is a gutter system that provides an impermeable seal between the gutter and existing, flexible, self-sealing rubberized asphalt underlayment waterproofing material in order to protect the house from moisture damage. Such an apparatus would not require specially formed plates which match the slope of the roof.

SUMMARY OF THE INVENTION

The gutter system of the present invention includes a channel-shaped elongated member that has a first wall which is opposite a second wall, and a floor. The second wall has a distal portion which is bifurcated into a primary wall and a secondary wall. This distal portion forms a receiving channel. There is also a sealing means for forming a watertight seal between an underlayment waterproofing material and the receiving channel.

In one embodiment, the receiving channel is composed of a malleable material wherein the primary wall of the receiving channel is externally marked in order to provide a guideline for crimping the channel. This ensures a watertight seal after the application of caulk to the crimped area.

In another embodiment, the primary wall of the receiving channel is angled toward the secondary wall so that the width of the receiving channel opening is slightly smaller than the thickness of the underlayment material. When the receiving channel is pried open by hand or tool, the underlayment roofing material snugly fits into the channel, thereby forming a watertight seal after caulk is applied.

Because the gutter is sealed to the underlayment material, water is unable to penetrate the joint between the two parts; therefore, the house is protected against ice dams brought about by the freeze-thaw cycle. This improvement is a valuable benefit because in the prior art, water and ice were still able to get beneath the underlayment on the eaves of the roof, thereby causing damage. When the two pieces are sealed to effectively become one, the prior problem is eliminated.

Because the gutter works with flexible self-sealing underlayment material, specially formed plates which match the slope of the roof and are not self-sealing are not required.

Still further features and advantages will become apparent from the ensuing description and drawings.

DETAILED DESCRIPTION

Figure 1:
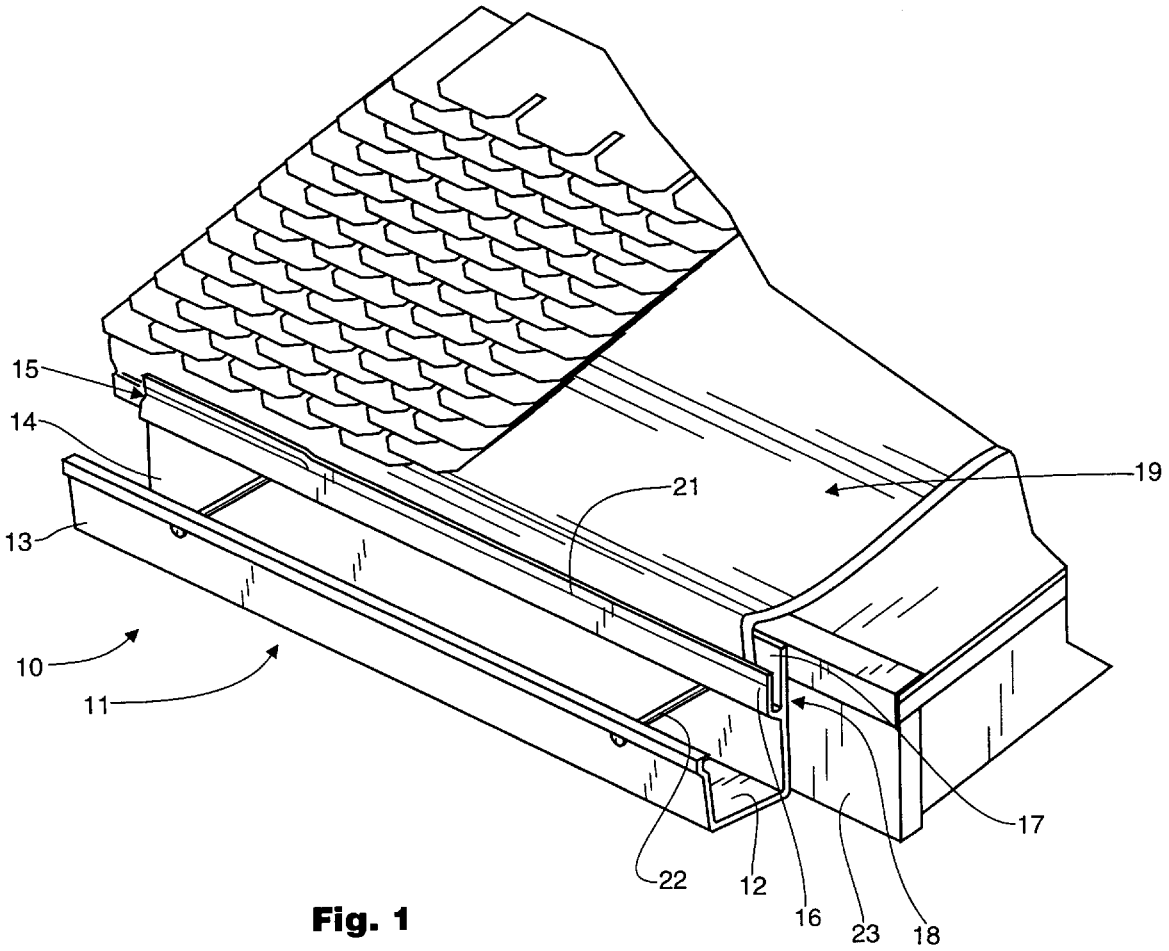
FIG. 1 is a perspective view of the gutter system of the present invention.

FIG. 1 is a perspective view of the gutter system 10 of the present invention. As shown, it includes a channel-shaped elongated member 11 that has a first wall 13 which is opposite a second wall 14, and a floor 12. The second wall 14 has a distal portion 15, which is bifurcated into a primary wall 16 and a secondary wall 17. This distal portion 15 forms a receiving channel 18 for receiving an underlayment waterproofing material 19 therein. In this embodiment, the receiving channel 18 is composed of a malleable material wherein the primary wall 16 of the receiving channel 18 is externally marked in order to provide a guideline 21 for crimping the channel 18. This ensures a watertight seal after the application of caulk to the crimped area.

Figure 2:
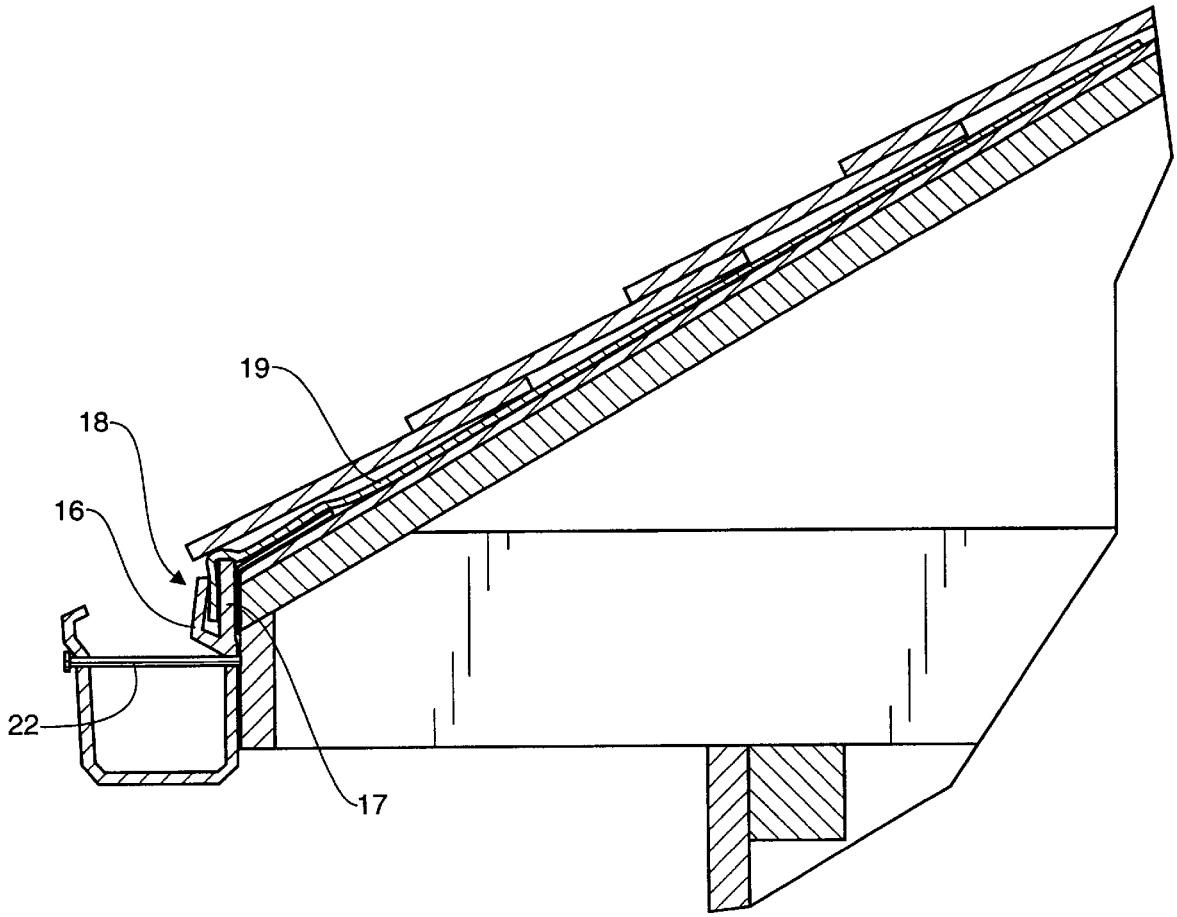
FIG. 2 is a cross-sectional view of another embodiment.

FIG. 2 is a cross-sectional view of another embodiment. Here, the primary wall 16 of the receiving channel 18 is angled toward the secondary wall 17 so that the width of the opening of the receiving channel 18 is slightly smaller than the thickness of the underlayment material 19. When the receiving channel 18 is pried open by hand or tool 25, the underlayment roofing material 19 snugly fits into the channel 18, thereby forming a watertight seal after caulk is applied. An elongated nail 22 attaches the gutter system 10 to the fascia 23 in a well-known manner. Also well-known is a drainage hole (not shown) at an end of the gutter system which attaches to a downspout (also not shown) in order to transport water to the ground. Further, common well-known accouterments, which could be used, include end caps and screens; however, they are not shown in the drawings. While some embodiments of the present invention will be extruded on-site, still other embodiments will come in pre-cut lengths, requiring a connecting device.

Figure 3:
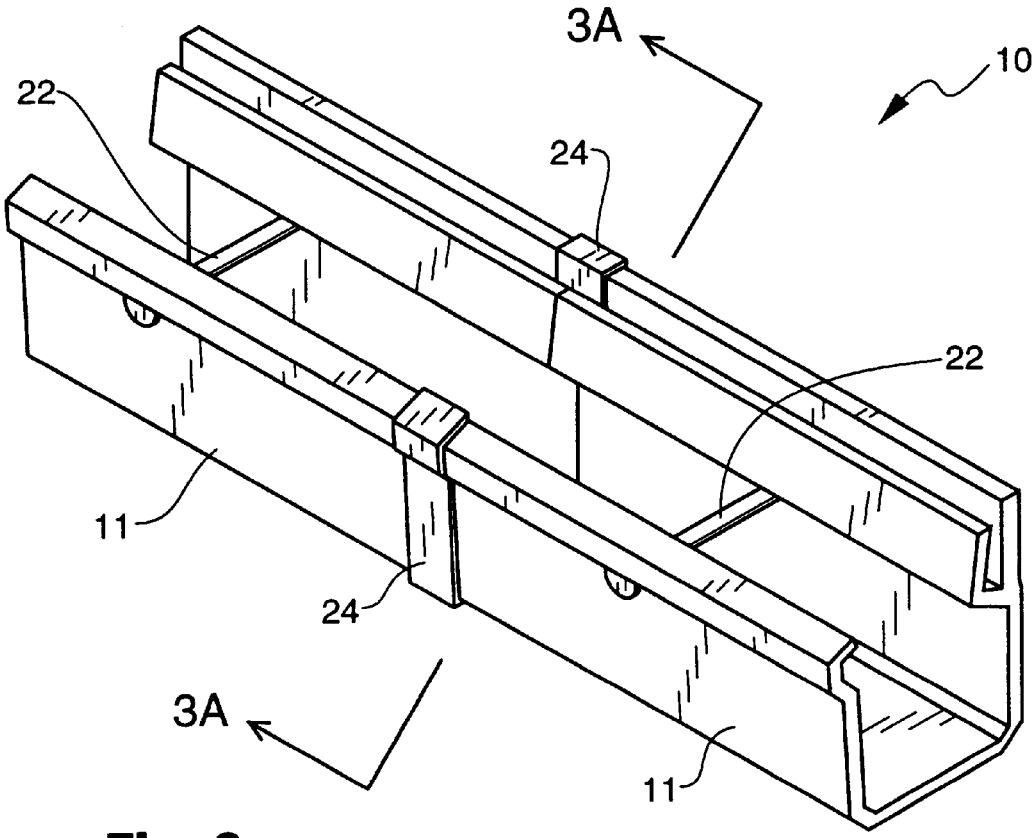
FIG. 3 is a perspective view of the gutter system, highlighting the various connectors.

FIG. 3 is a perspective view of the gutter system, highlighting the various connectors. In particular, there is shown a perspective view of the connection between one piece of the gutter system 10 and another.

Figure 3A:
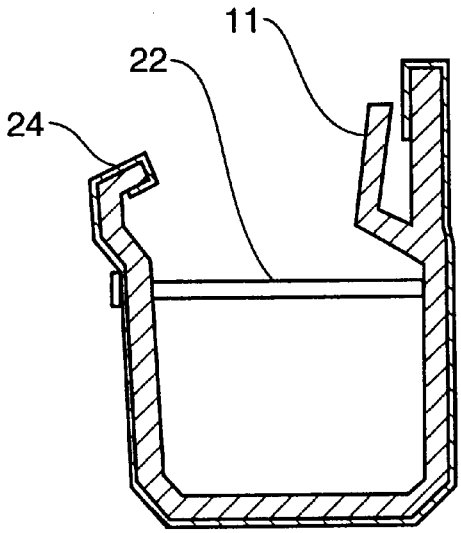
FIG. 3A is a cross-sectional view taken along line 3A—3A of FIG. 3.

FIG. 3A is a cross-sectional view taken along line 3A—3A of FIG. 3. The elongated members 11 abut each other and are firmly received by a connector clip 24. Once firmly in place, the joint is caulked so that it remains watertight.

Figure 4:
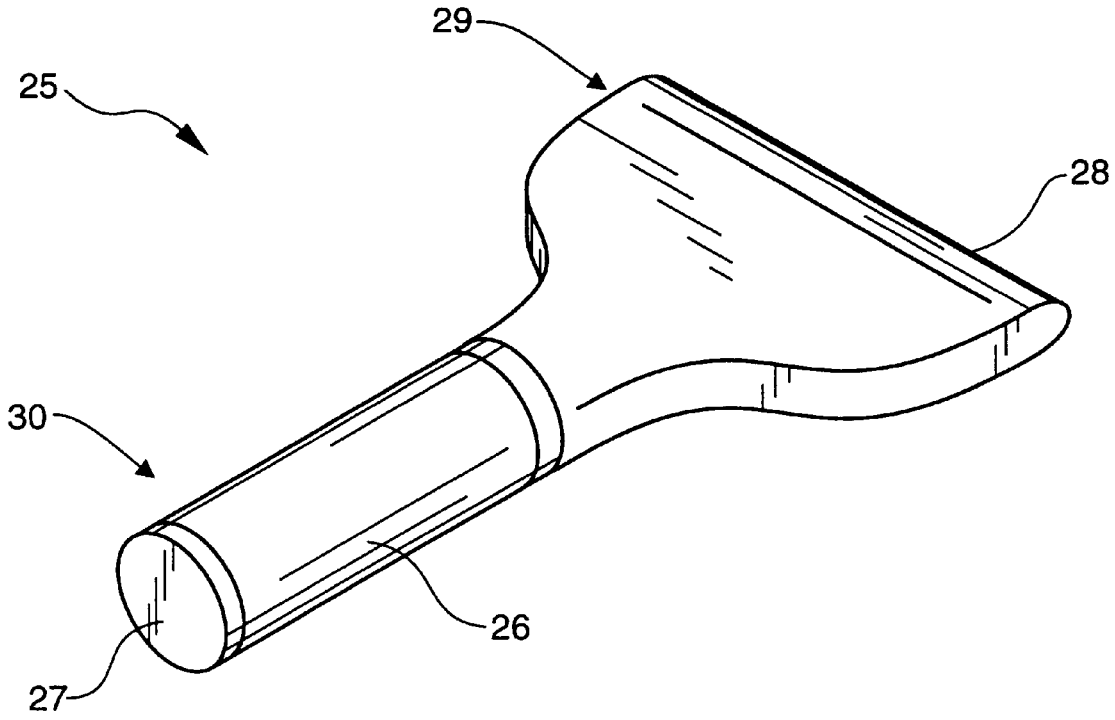
FIG. 4 is a perspective view of the crimping tool used in one of the embodiments.

In FIG. 4, there is shown a perspective view of the crimping tool 25 used to deform a malleable embodiment of the gutter system 10 around an underlayment waterproofing material. The tool consists of a handle 26 at one end 30 with a flat surface 27 to receive a striking blow from a hammer or other object, and a rounded chisel-like crimping surface 28 at the other end 29.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A gutter system comprising:

a. a channel-shaped elongated member having a first wall opposite a second wall, and a floor connected to the first and second walls;

b. the second wall having a distal portion forming a receiving channel which is continuous along substantially an entire length of the member and which is adapted to sealingly receive a proximal edge of an underlayment waterproofing material;

c. the receiving channel having an opening which is directed upwardly when the elongated member is installed with the first and second walls directed upwardly away from the floor;

d. the receiving channel including a primary wall and a secondary wall adapted to receive the waterproofing material there-between; and e. the primary wall being angled toward the secondary wall in order to firmly grip the waterproofing material within the receiving channel.

2. The gutter system of claim 1, wherein the primary wall is externally marked in order to provide a guideline for crimping the receiving channel against the waterproofing material.

3. A method for preventing water penetration through a roof comprising the steps of:

a. positioning an underlayment waterproofing material which self-seals around fasteners which penetrate the material on a roof in such a manner that an edge of the material extends beyond an eave of the roof, the waterproofing material being of sufficient pliability that the waterproofing material is rollable and unrollable by hand without equipment;

b. fastening shingles to the roof on top of the waterproofing material; and c. forming a watertight seal between the waterproofing material and a gutter by inserting the edge of the waterproofing material into a receiving channel which is watertight seal between the waterproofing material and the receiving channel.

4. The method of claim 3, wherein the watertight seal between the waterproofing material and the receiving channel is formed by crimping the receiving channel to urge against the waterproofing material, and then applying caulk to the receiving channel.

5. The method of claim 3, wherein the watertight seal between the waterproofing material and the gutter is formed by prying a primary wall of the receiving channel away from a secondary wall of the receiving channel, then inserting the edge of the waterproofing material into the receiving channel, then releasing the primary wall to permit the primary wall to urge against the waterproofing material, then applying caulk to the receiving channel.

6. An ice dam prevention system comprising:

a. a channel-shaped elongated member having a first wall opposite a second wall, and a floor connected to the first and second walls;

b. an underlayment waterproofing material;

c. the second wall having a distal portion forming a receiving channel which is continuous along substantially an entire length of the member and which is configured to sealingly receive a proximal edge of the waterproofing material; and d. the receiving channel having an opening which is directed upwardly when the elongated member is installed with the first and second walls directed upwardly away from the floor.

7. The gutter system of claim 6, wherein:

a. the receiving channel is composed of a malleable material;

b. the receiving channel includes a primary wall and a secondary wall configured to receive the waterproofing material there-between; and c. the primary wall is externally marked in order to provide a guideline for crimping the receiving channel against the waterproofing material.

8. The gutter system of claim 6, wherein:

a. the receiving channel includes a primary wall and a secondary wall configured to receive the waterproofing material there-between; and b. the primary wall is angled toward the secondary wall such that the opening is slightly narrower than a thickness of the waterproofing material, and the primary wall must be pulled away from the secondary wall in order to fit the waterproofing material within the receiving channel, whereby the waterproofing material is firmly gripped within the receiving channel.

* * * * *